US007053364B2

(12) United States Patent
Glück et al.

(10) Patent No.: US 7,053,364 B2
(45) Date of Patent: May 30, 2006

(54) REMOTELY OPERABLE SAFETY CABINET

(75) Inventors: Walter Glück, Hasselroth (DE); Stefan Mirsu, Frankfurt (DE); Gerd Ross, Frankfurt (DE)

(73) Assignee: Kendro Laboratory Products, GmbH, Hanau (DE)

( * ) Notice: Subject to any disclaimer, the term of this patent is extended or adjusted under 35 U.S.C. 154(b) by 322 days.

(21) Appl. No.: 10/414,221

(22) Filed: Apr. 16, 2003

(65) Prior Publication Data

US 2003/0227238 A1 Dec. 11, 2003

(30) Foreign Application Priority Data

Apr. 17, 2002 (DE) ..... 102 17 100

(51) Int. Cl.
*H01J 40/14* (2006.01)

(52) U.S. Cl. ..... 250/239; 250/221

(58) Field of Classification Search ..... 250/221, 250/239, 214 R, 551; 340/825.29, 5.61, 340/5.64; 70/78, 277, 288; 312/319.5, 223.6

See application file for complete search history.

(56) References Cited

U.S. PATENT DOCUMENTS 5,568,963 A * 10/1996 Bennett et al. ..... 353/122
6,374,649 B1 * 4/2002 Holcomb et al. ..... 70/78

FOREIGN PATENT DOCUMENTS

DE 4441784 C2 5/2003

* cited by examiner

*Primary Examiner*—Que T. Le
(74) *Attorney, Agent, or Firm*—Baker & Hostetler LLP

(57) ABSTRACT

The invention pertains to a safety cabinet with an interior enclosed by a housing and with a housing front comprising a working opening that can be closed with a height-adjustable front pane. The safety cabinet exhibits a fixed operating unit for controlling device functions that is integrated into the housing. A remote operating unit for controlling device functions that is spatially separated from the safety cabinet is also present. A receiver for receiving control signals emitted by the remote operating unit is also integrated into the safety cabinet. The remote operating unit not connected to the housing of the safety cabinet can be taken into the interior of the safety cabinet and removed from it by the operator without the necessity for the hands to touch non-sterile areas to operate the safety cabinet. Thereby the danger of contamination by entraining contaminants from the exterior into the interior is markedly reduced.

16 Claims, 2 Drawing Sheets

REMOTELY OPERABLE SAFETY CABINET

FIELD OF THE INVENTION

The invention pertains to a remotely operable safety cabinet, in particular, a safety cabinet whose functions can be controlled with an infrared remote operating unit.

BACKGROUND OF THE INVENTION

Conventional microbiological safety cabinets generally have a fixed operating unit installed that is usually mounted on the outside of the housing. For example, such a safety cabinet is described in the applicant's DE 4441784 C2. To use the functions of the safety cabinet while working, the user must remove his hands from the internal workspace enclosed by a housing. In the process, traces of the microbiological cultures being handled in the workspace can be inadvertently brought to the exterior on the hands and cause contamination there. Conversely, it is possible when using the nonsterile operating element outside the housing for contaminants to be brought into the interior of the safety cabinet. In the worst case, this can lead to damaging of the cultures being handled and to falsification of the experimental results.

SUMMARY OF THE INVENTION

The problem of the invention is correspondingly to specify a microbiological safety cabinet in which the danger of transferring contaminants into the interior serving for the processing of specimens, as well as that of transferring contaminants out of this interior, is reduced to the greatest extent possible.

The problem is solved by the safety cabinet according to claim 1. Preferred embodiments and refinements of the safety cabinet are to be drawn from the dependent claims.

The invention thus pertains to a safety cabinet with an interior enclosed by a housing and a housing front side that has a working opening that can be closed by a height-adjustable front pane. The safety cabinet comprises a fixed operating unit for controlling device functions that is integrated into the housing and which can in principle be constructed like operating units in conventional safety cabinets. In addition to the fixed integrated operating unit, the safety cabinet according to the invention possesses a remote operating unit for controlling device functions that is spatially separated from the cabinet. In order to receive the control signals transmitted by the remote operating unit, a receiver is also integrated into the safety cabinet.

The remote operating unit, which is not connected to the housing of the safety cabinet, can be taken into the interior of the safety cabinet and removed from it by the operator without nonsterile areas having to be touched by the hands. Thereby the danger of contamination by entraining contaminants from the exterior into the interior of the cabinet is markedly reduced. In order to prevent contaminants from the interior of the cabinet from being carried into the exterior, the remote operating unit can first be decontaminated in a conventional manner. Spray disinfectants, for instance, are suitable for this.

In a preferred embodiment of the invention, the remote operating unit is enclosed by a removable protective sleeve. On the one hand, this protective sleeve makes disinfection of the remote operating unit easier and, on the other, it can be removed and disposed of before a change of location to prevent entrainment of contaminants adhering to the protective sleeve.

In a refinement of the invention, several remote operating units per safety cabinet can be used. Then, for instance, one of the remote operating units can remain inside the safety cabinet, while another remote operating unit is used outside the safety cabinet. To avoid confusion, the remote operating unit for the interior and that for the exterior can be visually distinguished from one another. They can, for instance, by marked with different colors.

All frequencies used for remote operation can in principle be considered. For safety reasons, however, care should be taken that the signals emitted from the remote operating unit do not impair either the device functions of the safety cabinet itself or the functions of equipment that may be set up in the vicinity of the safety cabinet. Conversely, radiation emitted by the adjacent equipment must not cause malfunctions of the safety cabinet. For this reason, it is preferable to use an infrared remote operation unit within the scope of the invention. Preferred modulation frequencies lie in the range between 34 and 42 kHz, most preferably at 38 kHz. At these frequencies, neither disruption of functions in the safety cabinet itself nor in other equipment usually set up in the vicinity of the safety cabinet in laboratories, hospitals or elsewhere is to be expected. The receiver for the signals of the remote operating unit that is integrated into the safety cabinet is appropriately constructed to receive the aforementioned transmitted frequencies. Infrared transmitters and receivers with the above-indicated specifications are known in principle from other fields and therefore need not be explained further here.

With the remote operating element of the invention, essentially all device functions of a safety cabinet can be controlled. For example, the remote operating unit according to the invention controls at least one of the following device functions: turning the safety cabinet on or off, turning receptacles integrated into the safety cabinet on and off, turning the device lighting system on and off, moving the adjustable front pane to open and to close, turning a disinfection unit on and optionally also off, enabling a contact during secure operation of the safety cabinet, setting a timer for time-offset operation of the safety cabinet, selecting certain menu functions or display functions in a display or adjusting device parameters and service settings.

In principle, it is possible to assign a given key or key combination on the remote operating unit to a defined device function. Alternatively, controlling by means of the remote operating unit can be accomplished under menu control by calling up given menu items and confirming the selected menu function that is displayed for instance on a display element. Combinations of the two possibilities are also possible. The display element here can be located in the remote operating unit and/or in the safety cabinet itself.

The fixed operating unit integrated into the safety cabinet can in principle be constructed as known in prior art. According to the invention, however, it is preferred if the fixed integrated operating unit serves only to control the basic functions of the device. This involves at least one of the following functions: turning the safety cabinet on and off, turning venting or lighting on and off, turning on the supply voltage for the integrated electrical outlets, moving the height-adjustable front pane and acknowledging an alarm signal that can be initiated in case of malfunctions of the safety cabinet. The fixed integrated operating unit thus preferably serves merely as an emergency switch for the case when controlling the device by means of the remote operating unit is no longer possible, whether the remote operating unit has been misplaced or has failed. The relationship between fixed integrated operating unit and remote operating unit is therefore expediently such that the control signals emitted by the fixed integrated operating unit have a higher priority than the control signals emitted by the remote operating unit. With the fixed integrated unit it is thus possible to reverse or modify functions controlled by the remote operating unit.

In order to rule out maloperation as much as possible, the remote operating unit and/or the operating unit integrated into the safety cabinet can be constructed such that a defined duration of issuing a command, i.e., a defined duration of pressing a button or switch, is necessary to initiate a given device function. This time coding can be provided for one or more command functions, for instance, the function of turning the safety cabinet on and off.

It can additionally be provided for the remote operating unit and/or the fixed integrated operating unit that no control signal is issued in case of simultaneous or essentially simultaneous pressing of several keys or switches. In this way, malfunctions due to the inadvertent pressing of adjacent buttons can be prevented.

To inform the user of the operating state in which the safety cabinet is currently located and/or to display the operating menu or the device function triggered by the remote operating unit or the fixed integrated operating unit, the safety cabinet according to the invention expediently features a display element. The latter is preferably arranged in the area of the housing of the safety cabinet and preferably in its interior, especially in the area of the rear housing wall. This display element can in principle correspond to the display element already used for conventional safety cabinets. It can, for example, be an LCD or LED display.

To prevent the display element from negatively influencing the flow conditions in the interior, it is preferably integrated into a housing wall such that it is flush with the latter. If this is not possible for reasons of space and the display element projects into the interior, it preferably comprises a housing that is constructed in streamlined form. This can be done, for instance, by slanting the lateral areas of the display element housing. The housing of the remote operating unit may also be streamlined in shape.

It is particularly preferred that the receiver for the remote operating unit be integrated into the display element. Even if the display element is placed in the interior of the safety cabinet, reception of control signals that are emitted from a remote operating unit located outside the safety cabinet is possible without difficulty through the front pane or the side walls of the safety cabinet.

Rests for the remote operating unit can be placed on the device exterior and/or in the interior of the safety cabinet.

BRIEF DESCRIPTION OF THE DRAWINGS

The invention will be explained in greater detail below on the basis of a drawing. Shown schematically therein are FIG. 1, a safety cabinet according to the invention with associated remote operating unit in a perspective view.

DETAILED DESCRIPTION OF THE PREFERRED EMBODIMENT

Figure 1:
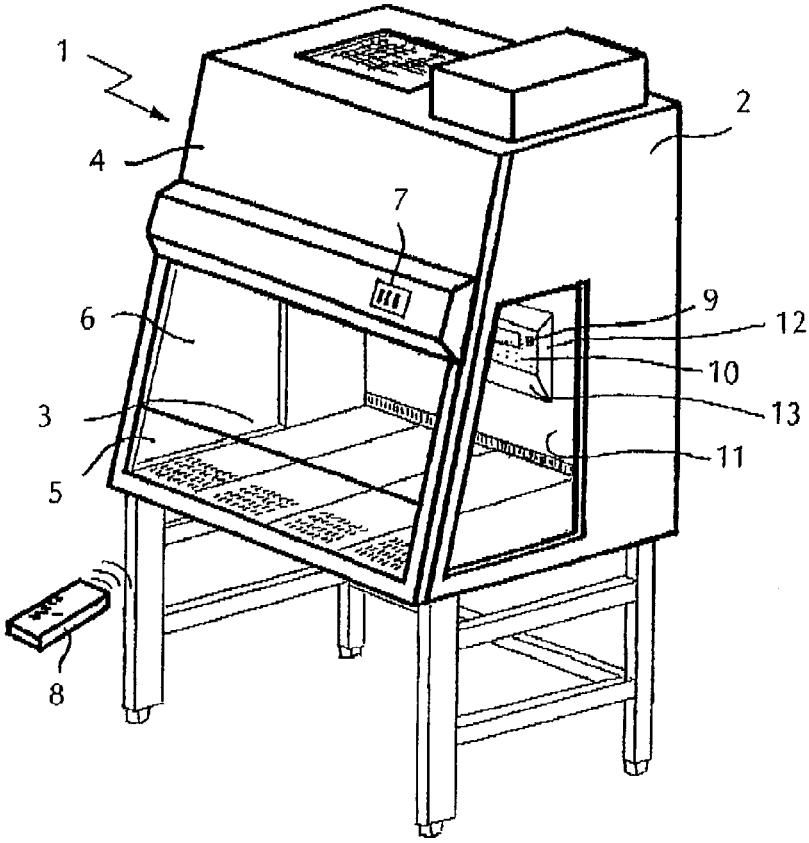

In detail, FIG. 1 shows a safety cabinet 1 according to the invention with an interior 3 that is enclosed by a housing 2. A working opening 5 in the housing front 4 permits access to interior 3 and is closed off by a height-adjustable front pane 6. Safety cabinet 1 corresponds in principle to a conventional safety cabinet as described, for instance, in DE 4441784 C2, and comprises a venting system that also fundamentally corresponds to prior art. The manner of operation for the safety cabinet according to the invention, however, differs from that of conventional safety cabinets. Operation of the safety cabinet is accomplished mainly by means of a remote operating unit 8 that is not spatially connected to the safety cabinet. Remote operating unit 8 permits the controlling of all device functions, such as turning the cabinet on and off, regulating the venting system, turning the lighting on and off, raising and lowering front pane 6, turning the electricity receptacles integrated into the device on and off, controlling display element 10 integrated into housing back wall 11, the disinfection of the safety cabinet, the programming of a timer, the enabling or blocking of contacts, the setting of device parameters or making or modifying service settings, etc.

Figure 2:
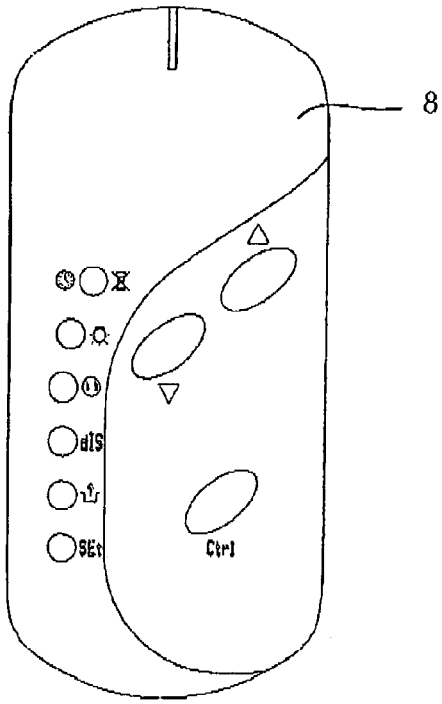
FIG. 2, the remote operating unit in keeping with FIG. 1 in a plan view.

To this end, various buttons with which the individual device functions can be initiated are provided. This is reflected by way of example in the remote operating unit shown in FIG. 2. On the left side of the remote operating unit 8, six buttons with which individual device functions can be controlled are arranged one above the other. The topmost button, for instance, serves to call up the timer, the second highest one for turning the device lighting on and off, and so on. Menu items in the operating menu can be called up with the two upper buttons in the right-hand area of remote operating unit 8. The respective menu item that has been called up is displayed to the user in display element 10, which is integrated into the rear housing wall 11 of safety cabinet 1.

Housing 12 of display element 10 projects slightly into interior 2 of safety cabinet 1. Housing 12 is streamlined so as to disrupt the flow conditions inside interior 3 as little as possible. To that end, lateral edge areas 13 of housing 12 are slanted, so that the housing increases gradually in height from the edge to the middle.

Figure 3:
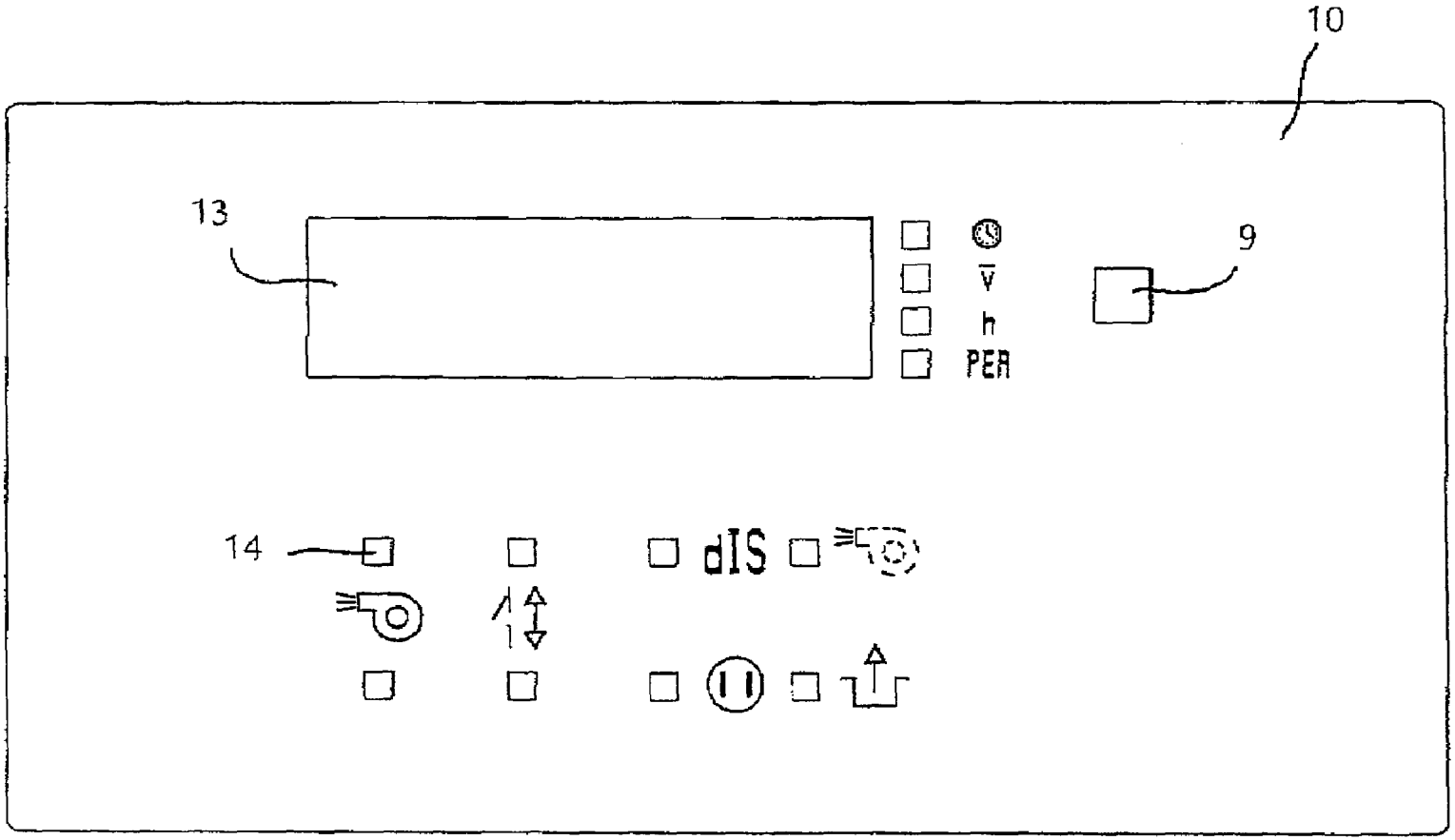
FIG. 3, the display element with integrated receiver of the safety cabinet according to FIG. 1 in a plan view.

Display element 10 is shown in greater detail in FIG. 3. Only the display area is shown, while the enclosing lateral housing is omitted. In its upper area, display element 10 possesses a display 13 for reproducing a menu text or some other message, for instance, an error message. Also present are various light-emitting diodes 14, from which the user of the safety cabinet can discern the operating status and the current menu level of the operating menu in which he is working. Receiver 9 for receiving control signals from remote operating unit 8 is also integrated into display element 10. The receiver is only schematically shown here.

In concrete terms, the receiver may, for the sake of example, be one with a modulation frequency of 38 kHz (for instance IC SFH5110-38 from Osram GmbH). The bursts each consist of six pulses with a duration of 13 μsec, so that a burst is 156 μsec long. The transmission information is coded by means of the spacing of the bursts. There are two spacings, namely long (1.792 msec, corresponding to logic 0) and short (1.280 msec, corresponding to logic 1). The times are measured in each case from the beginning of one burst to the beginning of the next burst. A complete transmission pattern consists of a total of 17 bits, a start bit and two times eight information bits. The first eight bits represent the code and the second eight bits repeat the code as its complement. Thus the total duration is always 24.576 msec. The code consists of four bits for transmitter recognition and four bits for button recognition. To avoid unintentional maloperation, no signal is sent if several buttons are pressed simultaneously within 50 msec.

In addition to remote operating unit 8, the safety cabinet 1 according to the invention comprises an operating element 7 integrated into the cabinet. It is shown here only schematically, but can in principle correspond to the operating elements of prior art. According to the invention, integrated operating element 7 serves mainly as a safety or emergency switch, for instance, for a case in which remote operating unit 8 has been misplaced or has a malfunction. Operating element 7 is thus reduced to controlling the basic device functions. These are, for instance, turning the cabinet on and off and turning on the venting or the lighting or the supply voltage for the integrated receptacles. Front pane 6 can also be moved up and down by means of integrated operating unit 7. Expediently it is also possible to acknowledge with operating element 7 an alarm signal initiated in case of a malfunction of safety cabinet 1. Commands issued with operating unit 7 have priority over those given with remote operating unit 8. In this manner, it is assured that safety cabinet 1 can be operated from integrated operating unit 7 in case of a malfunction of remote operating unit 8.

What is claimed is:

1. A safety cabinet with an interior enclosed by a housing and with a housing front comprising a working opening that can be closed with a height-adjustable front window and an operating unit controlling device functions of devices being integrated into said housing, characterized in that the safety cabinet has a remote operating unit spatially separated from said cabinet for controlling device functions and in that a receiver for receiving control signals emitted by the remote operating unit is integrated into said safety cabinet.

2. The safety cabinet according to claim 1, characterized in that the remote operating unit is an infrared remote operating unit that preferably emits control signals with a modulation frequency of 34–42 kHz and, in particular, at 38 kHz, and in that the receiver is constructed to receive these control signals.

3. The safety cabinet according to claim 1, characterized in that at least one of the following functions can be controlled by the remote operating unit:

turning the safety cabinet on and off;

switching electricity receptacles integrated into the safety cabinet;

turning the device lighting on and off;

moving the adjustable front pane;

turning a disinfection unit on;

enabling a contact in secure operation of the safety cabinet;

setting a timer;

selecting display settings; or setting device parameters and service settings.

4. The safety cabinet according to claim 1, characterized in that the operating unit integrated into the housing serves only for operating basic device functions, in particular, for:

turning the safety cabinet on and off;

turning venting on;

turning the lighting on;

turning on the supply voltage for the integrated receptacles;

moving the height-adjustable front pane; or acknowledging an alarm signal.

5. The safety cabinet according to claim 1, characterized in that a predetermined duration of actuation of the remote operating unit or the operating unit is necessary to start or end a device function.

6. The safety cabinet according to claim 1, characterized in that the remote operating unit and/or the operating unit are constructed such that no signal is sent in case of simultaneous or essentially simultaneous pressing of a plurality of buttons or switches.

7. The safety cabinet according to claim 1, characterized in that control signals emitted from the operating unit have a higher priority than control signals emitted by the remote operating unit.

8. The safety cabinet according to claim 1, characterized in that a display element that displays an operating menu and/or the current operating status of the safety cabinet is present in the area of the housing.

9. The safety cabinet according to claim 8, characterized in that the display element is arranged in the interior of the safety cabinet, preferably in a rear wall of the safety cabinet.

10. The safety cabinet according to claim 8, characterized in that the display element lies flush with a housing wall or comprises a streamlined housing projecting into the interior, in particular, a housing with slanted side areas.

11. The safety cabinet according to claim 8, characterized in that the receiver is integrated into the display element.

12. The safety cabinet according to claim 1, characterized in that the remote operating unit is enclosed by a removable protective sleeve.

13. The safety cabinet according to claim 1, characterized in that the safety cabinet has a first remote operating unit and a second remote operating unit.

14. The safety cabinet according to claim 1, characterized in that a rest for the one or more remote operating units is present in the interior and/or on a housing exterior.

15. The safety cabinet according to claim 13, characterized in that the first remote operating unit is configured to only be used inside the interior to prevent contamination.

16. The safety cabinet according to claim 13, characterized in that the second remote operating unit is configured to only be used outside the interior to prevent contamination.

* * * * *